United States Patent [19]

Kisler

[11] Patent Number: 4,825,334

[45] Date of Patent: Apr. 25, 1989

[54] HIGH POTENTIAL BRUSH POLARIZER

[75] Inventor: Semyon Kisler, W. Newton, Mass.

[73] Assignee: Polaroid Corporation, Cambridge, Mass.

[21] Appl. No.: 779,432

[22] Filed: Sep. 24, 1985

Related U.S. Application Data

[63] Continuation of Ser. No. 222,332, Jan. 5, 1981, abandoned.

[51] Int. Cl.[4] ..... H05F 3/00

[52] U.S. Cl. ..... 361/212; 361/225; 361/235; 361/221

[58] Field of Search ..... 361/225, 213, 229, 230, 361/235, 212, 221; 250/325

[56] References Cited

U.S. PATENT DOCUMENTS 2,774,921 12/1956 Walkup ..... 361/225
3,463,663 8/1969 Chopra ..... 361/225
4,158,071 6/1979 Jordan et al. ..... 427/33
4,213,167 7/1980 Cumming et al. ..... 361/213
4,402,035 8/1983 Kisler ..... 361/213

OTHER PUBLICATIONS

"Controlling Polar Charge with Low Electrical Potentials", Research Disclosure, 2/80, p. 70.

*Primary Examiner*—L. T. Hix
*Assistant Examiner*—D. Rutledge
*Attorney, Agent, or Firm*—John J. Kelleher

[57] ABSTRACT

The maximum subcorona potential level to which a particular conductive bristle brush is able to regulate an electrostatic charge on charge-retaining material is substantially increased by limiting the electrical current available to said particular conductive bristle brush from a potential source coupled to said brush to a level that is less than a magnitude necessary for corona generation.

8 Claims, 2 Drawing Sheets

HIGH POTENTIAL BRUSH POLARIZER

This is a continuation of application Ser. No. 222,332, filed Jan. 5, 1981 now abandoned.

BACKGROUND OF THE INVENTION

1. Field of the Invention

The present invention relates to apparatus for establishing a relatively uniform charge level on charge-retaining material, in general, and to such apparatus for establishing a uniform charge level on a moving web of such material, in particular.

2. Description of the Prior Art

The presence of electrostatic charges on charge-retaining materials causes problems in many industries. In the photographic industry, for example, electrostatic charges on potential photographs or film units within a light-tight film cassette containing a plurality of film units for use in an "instant" type photographic camera, such as that sold by Polaroid Corporation, Cambridge, Mass., under its registered trademark SX-70, will often cling to one another with such intensity as a result of tee force of attraction developed by such electrostatic charges, that proper ejection of an exposed film unit from said film cassette can be prevented if the effects of such charges are not controlled. In the SX-70 photographic film units mentioned above, for example, electrostatic charges are controlled by controlling the charge levels on components of said film prior to final film unit assembly.

In my copending U.S. patent application, Ser. No. 183,326, filed Sept. 2, 1980, a brush-like device is employed to establish a desired electrostatic charge level on a moving web of charge-retaining material by passing said web through a relatively intense electrostatic field generated by said device when it is electrically connected to a relatively low potential DC source of suitable magnitude and polarity. A similar but more limited disclosure of said brush-like device is contained at page 70 in the February, 1980, issue of "Research Disclosure".

A limitation of electrostatic charge-controlling conductive bristle brush apparatus presently employed to establish an electrostatic charge on charge-retaining material is the inability to place an electrical potential on such a brush that is much in excess of 4.5 KV without generating a corona on said conductive bristle brush. While corona might be acceptable in many charge-retaining material, charge-controlling applications, it is generally unsuitable for use with materials that are sensitive to light such as materials incorporated in many photographic products. In addition, corona produces ozone, and ozone has an odor that may be offensive to personnel in the vicinity of the corona source.

SUMMARY OF THE INVENTION

In accordance with the teachings of the present invention, improved conductive bristle brush electrostatic charge-controlling apparatus is provided that is capable of producing a relatively uniform charge level on charge-retaining materials at potential levels greater than a potential level where corona would normally occur. The apparatus includes an electrically conductive reference member, a brush having conductive bristles or filaments spaced from said reference member with one end of each of said bristles being connected to a common electrical conductor, a relatively low potential DC source connected between said common electrical conductor and said reference member, and means for limiting the current available to said conductive bristle brush from said potential source in order to prevent the generation of corona. The current limiting means may take the form of such things as a current limiting resistor or the addition of more conductive bristles in parallel with existing conductive bristles that limit and absorb, respectively, current necessary for the generation of corona, thereby preventing corona generation at said current limited conductive bristle brush.

DESCRIPTION OF THE PREFERRED EMBODIMENTS

In order to facilitate describing the preferred embodiments of the present invention, a brief description of electrostatic charge-controlling apparatus presently available in the prior art, over which the present invention is an improvement, will be provided.

Figure 1:
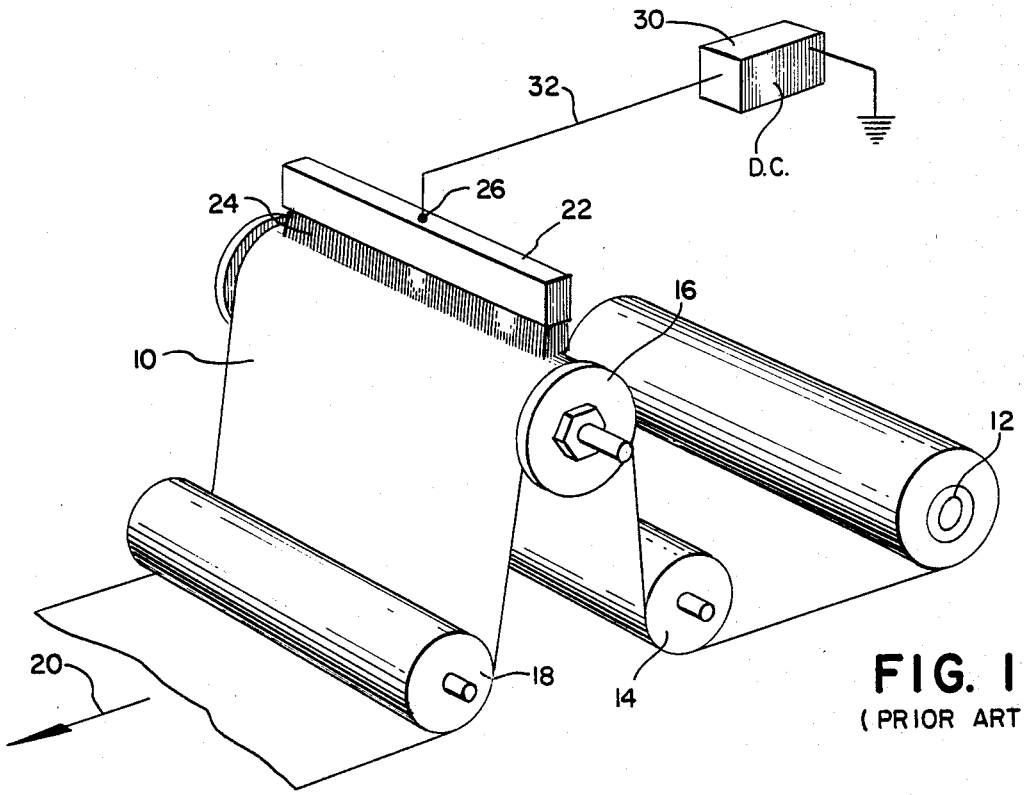
FIG. 1 (PRIOR ART)
FIG. 1 is a perspective view of a mechanical schematic of conductive bristle brush-type charge-controlling apparatus constructed in accordance with the prior art, and a moving web of charge-retaining material having its electrostatic charge controlled by said apparatus.
Figure 2:
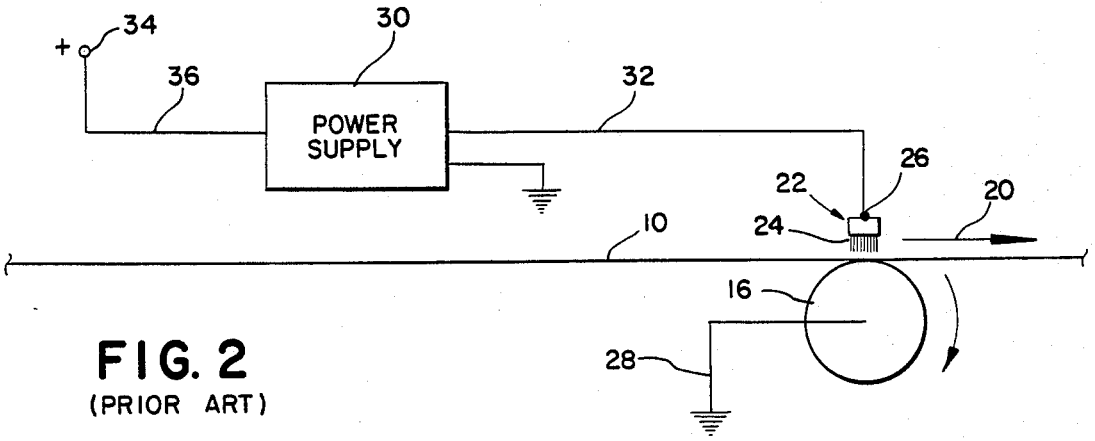
FIG. 2 (PRIOR ART)
FIG. 2 is an equivalent electrical schematic of the conductive bristle brush-type electrostatic charge-controlling apparatus depicted in FIG. 1.

Turning now to the drawings, in FIGS. 1 and 2, a perspective view of prior art charge-controlling apparatus controlling the electrostatic charge on a moving web of charge-retaining material 10 and an equivalent electrical schematic of said apparatus are respectively depicted. A roll of charge-retaining material 10 is moved over rotatably mounted cylindrical rollers 12, 14, 16 and 18 in direction 20 at the desired rate of web 10 movement by suitable drive means (not shown) coupled to said web 10.

Brush 22 is mounted in a fixed position and in a spaced relation with respect to web 10 and backing roller 16. The construction of brush 22 will be described below in detail. For the present, however, it should be noted that brush 22 does include a multiplicity of conductive bristles or filaments 24 with an end of each of said filaments being electrically connected to common electrical conductor 26. Backing roller 16 is constructed of electrically conductive materials and said roller 16 is connected to ground potential through path 28. The output of power supply or DC potential source 30 is connected to common electrical conductor 26 through path 32. The input of power supply 30 is connected to a source of electrical energy at terminal 34 (not shown) through path 36. Power supply 30 and grounded backing roller 16 are connected to the same ground potential. When power supply 30 is energized, a relatively intense electrostatic field is established between the free ends of bristles 24 of brush 22 and grounded backing roller 16. The use of a multiplicity of conductive bristles or filaments in the form of brush 22 coupled to a suitable potential source results in an electrostatic field being established between brush 22 and roller 16 by means of an electrial potential whose magnitude is substantially less than that necessary for the generation of corona. The reason for being able to establish a relatively intense field with a relatively low voltage will be explained below in detail.

As web 10 is moved in direction 20 over roller 16 between the free ends of bristles 24 and grounded roller 16, through the relatively intense electrostatic field established between said free bristle ends and said roller 16, electrostatic charges retained by said web 10 are controlled or regulated by said electrostatic field. The magnitude and polarity of the brush potential supplied by potential source 30 is established before web 10 is so moved, by empirically determining the electrostatic field intensity necessary for the desired degree of web 10 electrostatic charge regulation.

In the apparatus of FIGS. 1 and 2, brush 22 is spaced a finite distance from moving web 10. By so spacing said brush 22 from said moving web 10, the magnitude of the potential applied to said brush 22 must be increased in order to obtain the same electrostatic field intensity over a similar arrangement where brush 22 was in actual contact with web 10. This is so because the brush-to-web spacing introduces an electrical impedance or resistance to the generation of an electrostatic field between these components. The electrostatic charge level on web 10 can be properly regulated at lower DC potential when brush 22 is in direct contact with said web 10. However, scratching of the surface of web 10 may occur and such scratching may render portions of web 10 useless for incorporation in an end product.

Brushes employed to control the charge level on charge-retaining materials such as web 10 in FIGS. 1 and 2 usually have a bristle or filament density in excess of 120 K filaments per square inch and preferably in excess of 150 K filaments per square inch. The number of square inches of brush filaments and the physical dimensions of a particular brush are determined by considering such factors as speed of web movement, the initial web charge level and the type of material of which the web is formed. If, as in the charge-controlling arrangement of FIGS. 1 and 2, a web such as web 10 is moved over roller 16 at a relatively high rate of speed, it may be necessary to employ two or more commonly connected brushes and space them about the circumference of said roller 16 if a single brush is insufficient to establish the desired web charge level.

Brush 22 in FIGS. 1 and 2 includes a multiplicity of conductive bristles 24 with each of said bristles having one end connected to common electrical conductor 26, as previously noted. Bristles 24 of said brush 22 are circular in cross-section and are normally constructed of conductive materials such as conductive nylon or stainless steel. Practically any conductive material may be employed for use as bristle material so long as its electrical resistance is 500 megohms or less. Low resistances are not necessary because, unlike a corona-generated field, only a minute amount of current is utilized; primarily for leakage and for dipole orientation.

It is a well-known electrical phenomenon that more intense electrostatic fields can be generated at sharp angle or small radius of curvature surfaces for the same applied potential than at smooth or large radius of curvature surfaces. The most useful conductive bristle brushes have bristle diameters of 50 microns or less. With a bristle of this size, the surface at the tip or free end of said bristle forms a surface with a radius that approaches zero. With a radius of this magnitude, a relatively intense electrostatic field can be generated at the tip of such a bristle with a potential that is well below the approximately 4.5 KV DC level where a corona would normally first appear and very often at a potential of 1.5 KV DC.

Figure 3:
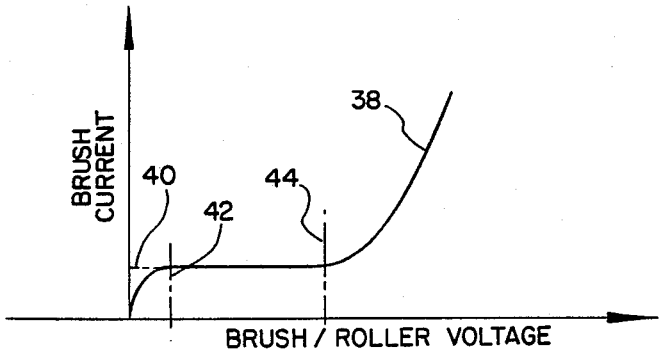
FIG. 3 (PRIOR ART)
FIG. 3 is a graph of conductive bristle brush current as a function of brush-to-backing roller voltage of the prior art charge-controlling apparatus of FIGS. 1 and 2.

In the operation of the prior art apparatus of FIGS. 1 and 2, web 10 is moved between the free ends of conductive bristle brush 22 and backing roller 16 in direction 14 by drive means (not shown) for the purpose of having its electrostatic charge level regulated by the electrostatic field established between brush 22 and roller 16. The intensity of this field is dependent upon the magnitude of the voltage between said brush 22 and said roller 16. For every brush 22-to-roller 16 voltage level there is a corresponding brush current level. As noted above, this brush current is primarily to compensate for current leakage and for web charging. A graph 38 of conductive bristle brush current as a function of brush 22-to-roller 16 voltage is shown in FIG. 3. As shown in FIG. 3, once brush 22 current increases to current level 40, said brush current remains relatively constant between brush-to-roller voltages 42 and 44. However, if the brush 22-to-roller 16 voltage is increased beyond voltage level 44, corona will be generated at said brush 22, and brush 22 current will increase in order to sustain said corona. The presence of corona is unacceptable in many electrostatic charge-regulating applications, especially when regulating electrostatic charges on light sensitive materials. The generation of corona at a particular brush 22-to-roller 16 voltage level limits the maximum electrostatic charge level that can be established on, for example, web 10 by brush 22 to a charge level corresponding to said particular brush 22-to-roller 16 voltage level if the presence of corona is to be avoided. The electrostatic charge regulating apparatus of the present invention substantially increases the charge level to which a charge on charge-retaining material can be regulated without generating an undesirable corona.

Figure 4A:
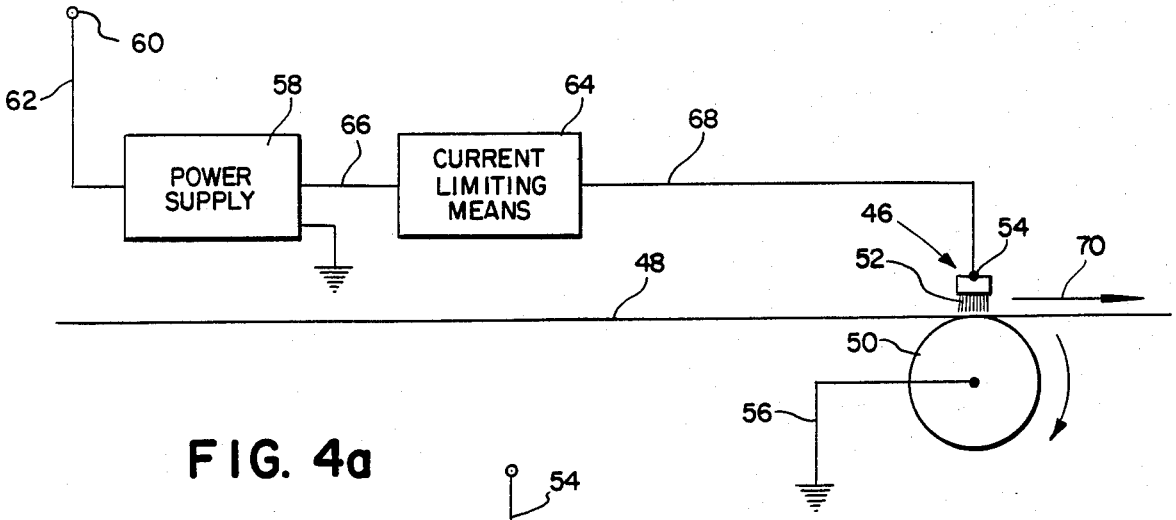
FIG. 4*a* is an electrical schematic diagram of conductive bristle brush-type electrostatic charge-controlling apparatus that incorporates the inventive concept of the present invention.

Turning now to the present invention and to FIG. 4*a*, where apparatus incorporating a preferred embodiment of said present invention is depicted. FIG. 4*a* is an electrical schematic diagram of conductive bristle brush-type electrostatic charge-controlling apparatus that incorporates the sub-corona electrostatic charge level increasing apparatus of the present invention. In FIG. 4*a*, brush 46 is mounted in a fixed position and in a spaced relation with respect to both web 48 and electrically conductive, rotatably mounted cylindrical backing roller 50. The construction of brush 46 is the same as that of brush 22 described above in FIGS. 1 and 2. As discussed above, a brush such as brush 46 in FIG. 4*a* includes a multiplicity of conductive bristles or filaments 42 with an end of each of said filaments being electrically connected to common electrical conductor 54. Backing roller 50 is constructed of electrically conductive material and said roller 50 is connected to ground potential through path 56. The input of power supply 58 is connected to a source of electrical energy at terminal 60 (not shown) through path 62. Power supply 58 and grounded backing roller 50 are connected to the same ground potential. The output of power supply or DC potential source 58 is connected to current limiting means 64 through path 66 and the output of current limiting means 64 is connected to common electrical conductor 54 of conductive bristle brush 46 through path 68.

As web of charge-retaining material 48 is moved in direction 70 between conductive bristle brush 46 and grounded backing roller 50, at the desired rate of web 48 movement, by suitable drive means (not shown) coupled to said web 58, the electrostatic charge level on web 48 is changed to the desired charge level by the relatively intense electrostatic field established between energized conductive bristle brush 46 and electrically conductive backing roller 50. If the electrostatic charge level sought to be established on, for example, web 48 by brush 46 is larger than a predetermined value, corona will be generated at said brush 46 when the magnitude of the electrical potential on said brush 46 supplied by power supply 58 equals or exceeds said predetermined value. By employing an embodiment of the inventive concept of the present invention, the electrical potential on said brush 46 may be substantially increased above said predetermined electrical potential value without producing corona.

In order to produce and/or sustain a corona, it is essential that sufficient current or ions be made available for movement between the corona-generating electrode and an electrically conductive reference member. By contrast, in the prior art sub-corona conductive bristle brush-type electrostatic charge-controlling apparatus of FIGS. 1 and 2, for example, only a minimal amount of current is necessary for proper control of electrostatic charges on a charge-retaining material. Whereas current in the order of milliamps is necessary for corona, conductive bristle brush current in the neighborhood of 10 microamps is sufficient for electrostatic charge-controlling purposes.

Whether or not corona will be generated at, for example, brush 46 in the electrostatic charge-controlling apparatus of FIG. 4A, is primarily dependent upon the number and size of bristles 52 of brush 46 as well as the magnitude of the potential applied to said brush 46. If the number of bristles in brush 46 is large enough, the desired electrostatic charge level may be obtained before corona develops. However, if corona should develop at a brush potential level necessary to obtain the desired electrostatic charge level on a charge-retaining material, said corona can be suppressed by limiting the available current to a level that is below that necessary to generate and/or sustain said corona.

Current limiting means 64 in FIG. 4*a* limits the current available to conductive bristle brush 46 from potential or power supply 58 to less than a level necessary for the generation of corona. Current limiting means 64 may take any number of different forms. In FIG. 4*b*, for example, current limiting means 64 of FIG. 4*a* takes the form of additional conductive bristles 72 in conductive bristle brush 74. It is useful to consider bristles 52 of conductive bristle brush 46 to be analogous to a multiplicity of resistors, of equal value, that are connected between path 66, that is connected to the high voltage output terminal of power supply 58, and ground path 56 in FIG. 4*a*. Such an arrangement is represented by resistors 52*a*, 52*b*, 52*c*, etc. in FIG. 4*c*. Bristles 72 of brush 74 are connected in parallel with bristles 52, which is analogous to adding resistors 72*a*, 72*b*, etc. in parallel with resistors 52*a*, 52*b*, 52*c*, etc. in FIG. 4*c*. In accordance with conventional electric circuit theory, by adding bristles 72 (resistors 72*a*, 72*b*, etc.) in parallel with bristles 52 (resistors 52*a*, 52*b*, 52*c*, etc.) current from power supply 58 in FIG. 4*a* that would otherwise flow through bristles 52 and generate corona is shunted through bristles 72 thereby suppressing corona generation If the placement of additional conductive bristles in parallel with existing bristles is either inappropriate or undesirable, current limiting means 64 in the charge-controlling apparatus of FIG. 4*a* may take the form of a current-limiting resistor. The ohmic valve of the resistance of said resistor must also be large enough to limit current to a level below that necessary for the generation of corona in order to suppress any corona that would otherwise be produced by, for example, brush 52 in FIG. 4*a*.

Figure 4C:
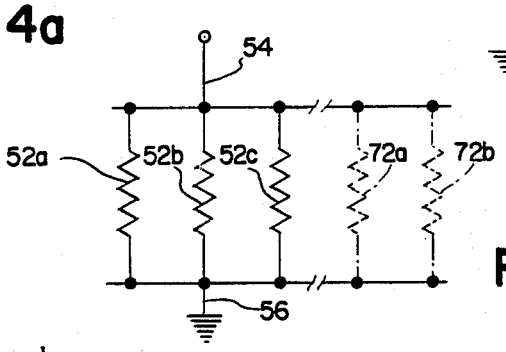
FIG. 4*c* is an electrical circuit that approximates the electrical impedance between the conductive bristle brush and the backing roller in FIG. 4*a* when additional bristles are employed.
Figure 5:
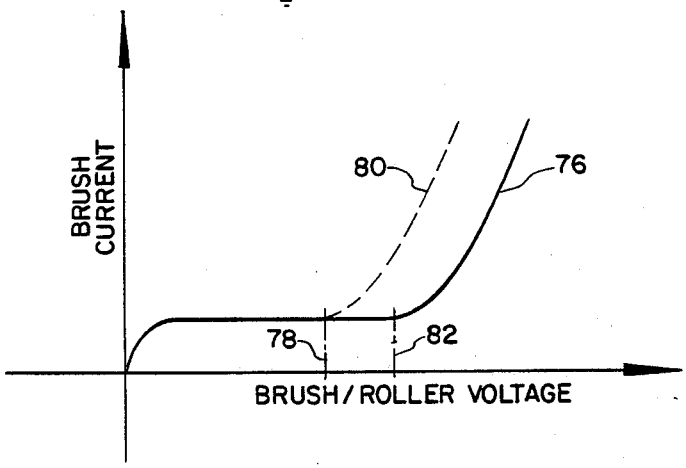
FIG. 5 is a graph of conductive bristle brush current as a function of brush-to-backing roller voltage of the charge-controlling apparatus of the present invention that is depicted in FIG. 4*a*.
Figure 4B:
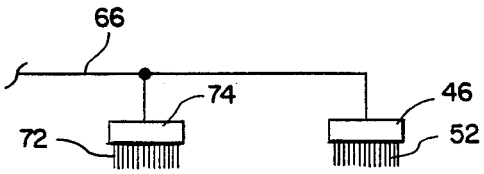
FIG. 4*b* is a schematic diagram of an additional conductive bristle brush connected in parallel with the conductive bristle brush schematically illustrated in FIG. 4*a*.

Whether it is the bristle increasing technique illustrated in FIGS. 4*b* and 4*c*, or the current limiting resistor mentioned above, the degree to which current through a conductive bristle brush must be limited to preclude the generation of corona is defined by the graph 76 of conductive bristle brush current as function of brush-to-roller voltage depicted in FIG. 5. As shown in FIG. 5, without additional bristles or a current limiting resistor, corona would begin to develop at brush-to-roller voltage 78 as brush current changed in accordance with graph 80 in said FIG. 5. However, by adding more conductive bristles or a current limiting resistor in the manner described above, corona would not develop until increased brush-to-roller voltage level 82 was established between brush 46 and roller 50 as brush current changed in accordance with graph 76 in FIG. 5.

The term "electrostatic field" employed herein means one species of electric field.

It will be apparent to those skilled in the art from the foregoing description of my invention that various improvement and modifications can be made in it without departing from its true scope. The embodiments described herein are merely illustrative and they should not be viewed as the only embodiments that might encompass my invention.

What is claimed is:

1. Apparatus for producing corona free, electrostatic charging at typical corona voltages of charge-retaining material under conditions wherein corona would have an adverse effect, said apparatus comprising:

an electrically conductive reference member;

an electrostatic brush having a plurality of conductive bristles mounted in spaced relation to said reference member for passage of charge-retaining material between said bristles and said member, said brush and reference member arrangement having a corona voltage threshold below which only an electrostatic field occurs with an attendant field current in the low microamp range and above which corona occurs with attendant current in the milliamp range; and a high voltage source producing a D.C. voltage between an output thereof and said member which exceeds said corona threshold voltage, means associated with said brush and said source for limiting the current to said brush to the microamp range so as to be less than the value of current which would normally occur at said corona voltage threshold thereby precluding corona while electrostatically charging said material at corona voltage.

2. The invention of claim 1 wherein said limiting means limits the current to a value in the low microamp range.

3. The invention of claim 1 wherein said limiting means limits the current to a value equal to or greater than 10 microamps, but substantially less than a milliamp.

4. The invention of claim 3 wherein said limiting means includes a current limiting resistor in series between said output and said brush to limit the current to said brush to less than said corona current.

5. A method of producing electrostatic charging of charge-retaining material at typical corona voltages under conditions wherein corona would have an adverse effect, comprising the steps of:

advancing said charge-retaining material between an electrically conductive reference member and the bristles of a conductive brush arrangement having a given corona threshold voltage below which only an electrostatic field occurs with an attendant field current in the low microamp range and above which corona occurs with attendant corona current in the milliamp range;

applying a DC voltage across said reference member and said brush arrangement in excess of said corona threshold voltage; and limiting the current flow to said brush arrangement to a value less than the value of corona current which would occur at said corona threshold thereby precluding corona while electrostatically charging said material at corona voltages.

6. The method of claim 5 wherein said limiting step limits the current to a value in the low microamp range.

7. The method of claim 5 wherein said limiting step limits the current to a value equal to or greater than 10 microamps, but substantially less than a milliamp.

8. The method of claim 5 wherein said limiting step includes providing a high voltage source with a current limiting resistor in series with said brush to limit the current to said brush to less than said corona current.

* * * * *